US009848268B2

(12) United States Patent
Kushima et al.

(10) Patent No.: US 9,848,268 B2
(45) **Date of Patent: *Dec. 19, 2017**

(54) ACOUSTIC GENERATOR, ACOUSTIC GENERATION DEVICE, AND ELECTRONIC APPARATUS

(71) Applicant: KYOCERA Corporation, Kyoto-shi, Kyoto (JP)

(72) Inventors: Noriyuki Kushima, Kyoto (JP); Kentarou Miyazato, Kyoto (JP); Tooru Takahashi, Kyoto (JP); Shuichi Fukuoka, Kyoto (JP); Kenji Yamakawa, Kyoto (JP); Masato Murahashi, Kyoto (JP); Hiroshi Ninomiya, Kyoto (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/110,881

(22) PCT Filed: Jan. 13, 2015

(86) PCT No.: PCT/JP2015/050590

§ 371 (c)(1),
(2) Date: Jul. 11, 2016

(87) PCT Pub. No.: WO2015/105196

PCT Pub. Date: Jul. 16, 2015

(65) Prior Publication Data

US 2016/0337759 A1 Nov. 17, 2016

(30) Foreign Application Priority Data

Jan. 11, 2014 (JP) ..... 2014-003806
Jan. 24, 2014 (JP) ..... 2014-011425
Mar. 18, 2014 (JP) ..... 2014-055022

(51) Int. Cl.
*H04R 17/00* (2006.01)
*H04R 7/26* (2006.01)
(Continued)

(52) U.S. Cl.
CPC ..... *H04R 17/005* (2013.01); *H04R 7/04* (2013.01); *H04R 7/18* (2013.01); *H04R 7/26* (2013.01);
(Continued)

(58) Field of Classification Search
CPC ..... H04R 17/00; H04R 17/005; H04R 7/26; H04R 2217/00
See application file for complete search history.

(56) References Cited

U.S. PATENT DOCUMENTS 5,638,456 A * 6/1997 Conley ..... G06F 1/1616 181/141
6,747,395 B1 * 6/2004 Satoh ..... H04R 17/005 310/324
(Continued)

FOREIGN PATENT DOCUMENTS

JP 2004-023436 A 1/2004
WO 2009/110575 A1 9/2009
WO 2010/106736 A1 9/2010

OTHER PUBLICATIONS

International Search Report, PCT/JP2015/050590, dated Mar. 10, 2015, 1 pg.

*Primary Examiner* — Matthew Eason
(74) *Attorney, Agent, or Firm* — Volpe and Koenig, P.C.

(57) ABSTRACT

There are provided an acoustic generator capable of generating a high-quality sound having little distortion, and an acoustic generation device and an electronic apparatus using the same. An acoustic generator has a vibration body, a first exciter, a second exciter, a first damping material and a second damping material. The vibration body has two sur-
(Continued)

faces which are positioned with a gap therebetween in a first direction. The first exciter and the second exciter are disposed on the vibration body. The first damping material is disposed on the vibration body and has a first portion which overlaps the first exciter when viewed in the first direction. The second damping material is disposed on the vibration body and has a second portion which overlaps the second exciter when viewed in the first direction.

13 Claims, 9 Drawing Sheets

(51) Int. Cl.
*H04R 7/04* (2006.01)
*H04R 7/18* (2006.01)
*H04S 7/00* (2006.01)

(52) U.S. Cl.
CPC ..... *H04R 17/00* (2013.01); *H04S 7/00* (2013.01); *H04S 2420/01* (2013.01)

(56) References Cited

U.S. PATENT DOCUMENTS 9,161,134 B2 * 10/2015 Inagaki ..... H04R 1/288
2009/0033177 A1 * 2/2009 Itaya ..... H03H 3/02 310/335
2011/0002485 A1 1/2011 Onishi et al.
2012/0203526 A1 * 8/2012 Bai ..... H04R 31/00 703/2
2013/0094681 A1 * 4/2013 Fukuoka ..... H04R 17/00 381/190
2015/0125009 A1 * 5/2015 Kamitani ..... H04R 1/28 381/191
2015/0172823 A1 * 6/2015 Fukuoka ..... B06B 1/0611 381/162
2015/0296303 A1 * 10/2015 Nakamura ..... H04R 7/18 381/162
2015/0304781 A1 * 10/2015 Nakamura ..... H04R 1/02 381/190
2016/0337758 A1 * 11/2016 Kushima ..... H04R 7/26

* cited by examiner

ACOUSTIC GENERATOR, ACOUSTIC GENERATION DEVICE, AND ELECTRONIC APPARATUS

TECHNICAL FIELD

The present invention relates to an acoustic generator, an acoustic generation device, and an electronic apparatus.

BACKGROUND ART

In the related art, there is a known speaker in which a piezoelectric element is attached to a vibration plate (for example, refer to Patent Literature 1).

CITATION LIST

Patent Literature

Patent Literature 1: Japanese Unexamined Patent Publication JP-A 2004-23436

SUMMARY OF INVENTION

Technical Problem

However, the above-described speaker in the related art has a problem in that distortion is significant and sound quality is poor.

The invention has been devised in consideration of the problem of the technology in the related art, and an object thereof is to provide an acoustic generator capable of generating a high-quality sound having little distortion, and an acoustic generation device and an electronic apparatus using the acoustic generator.

Solution to Problem

According to one embodiment of the invention, an acoustic generator includes a vibration body having two surfaces which are positioned with a gap therebetween in a first direction; a first exciter and a second exciter which are disposed on the vibration body; a first damping material disposed on the vibration body, the first damping material having a first portion which overlaps the first exciter when viewed in the first direction; and a second damping material disposed on the vibration body, the second damping material having a second portion which overlaps the second exciter when viewed in the first direction.

According to another embodiment of the invention, an acoustic generation device includes the acoustic generator mentioned above and an enclosure attached to the acoustic generator.

According to still another embodiment of the invention, an electronic apparatus includes the acoustic generator and an electronic circuit connected to the acoustic generator.

Advantageous Effects of Invention

According to the invention, the acoustic generator, the acoustic generation device, and the electronic apparatus can generate a high-quality sound having little distortion.

DESCRIPTION OF EMBODIMENTS

Figure 1:
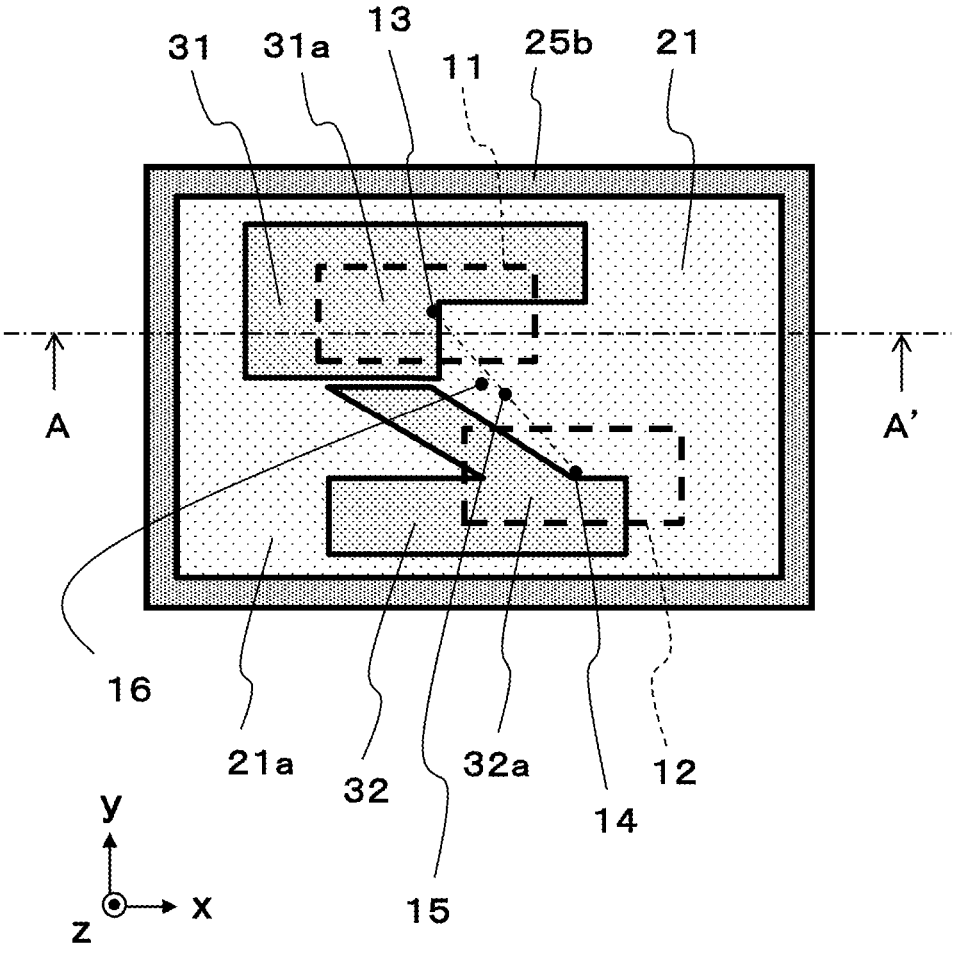
FIG. 1 is a plan view schematically illustrating an acoustic generator according to a first embodiment of the invention when viewed in a +z direction.

Hereinafter, according to embodiments of the invention, an acoustic generator, an acoustic generation device, and an electronic apparatus will be described in detail with reference to the accompanying drawings. In the drawings, directions are indicated by applying an x-axis, a y-axis, and a z-axis which are orthogonal to each other.

First Embodiment

Figure 2:
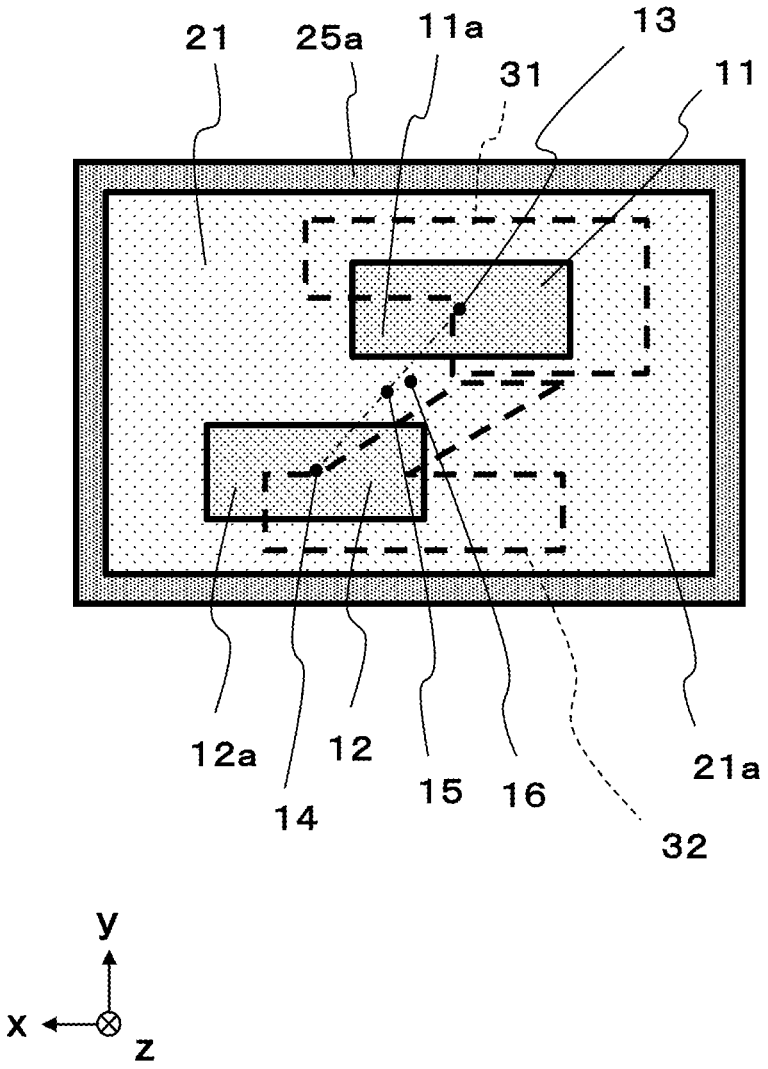
FIG. 2 is a plan view schematically illustrating the acoustic generator according to the first embodiment of the invention when viewed in a −z direction.
Figure 3:
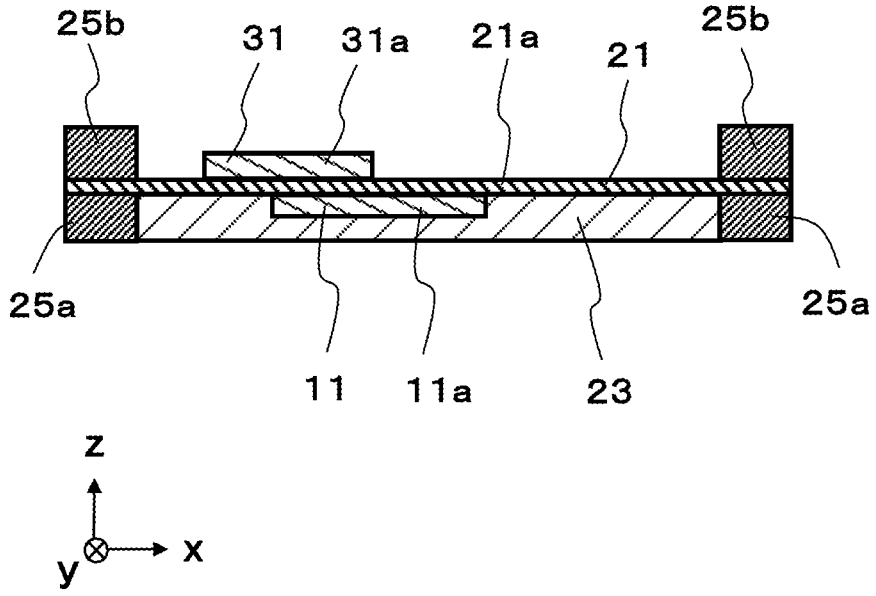
FIG. 3 is a sectional view taken along the line A-A' in FIG. 1.

FIG. 1 is a plan view schematically illustrating an acoustic generator according to a first embodiment of the invention when viewed in a +z direction. FIG. 2 is a plan view schematically illustrating the acoustic generator according to the first embodiment of the invention when viewed in a −z direction. FIG. 3 is a sectional view taken along the line A-A' in FIG. 1. FIG. 2 illustrates a state where a resin layer 23 is transparent. As illustrated in FIGS. 1 to 3, the acoustic generator of the present embodiment includes an exciter 11, an exciter 12, a film 21, the resin layer 23, a frame 25*a*, a frame 25*b*, a damping material 31, and a damping material 32.

Each of the frame 25*a* and the frame 25*b* has a rectangular frame shape. For example, as the frame 25*a* and the frame 25*b*, stainless steel materials each of which has a thickness ranging from 100 to 1000 μm can be favorably used. However, the material and the thickness are not particularly limited, and the material and the thickness less likely to be deformed compared to the film 21 and the resin layer 23 can be selected. For example, the frame 25*a* and the frame 25*b* can be formed by using a rigid resin, plastics, engineering plastics, glass, single crystal, ceramics, or the like.

The film 21 has a film-like (membrane-like) shape. For example, the film 21 can be formed by using a resin such as polyethylene terephthalate (PET) and polyimide. In addition, for example, the thickness of the film 21 ranges from 10 to 200 μm. Then, the circumferential edge portions on upper and lower main surfaces (a surface in the +z direction and a surface in the −z direction) of the film 21 are pinched by and fixed to the frame 25*a* and the frame 25*b* in a state where tensile force is present in a planar direction (a +x direction and a +y direction). The film 21 is supported by the frame 25*a* and the frame 25*b* so as to be able to vibrate. Then, a portion in the film 21 which is positioned within the frame 25*a* and the frame 25*b* and is not interposed between the frame 25*a* and the frame 25*b* is configured to be a vibration body 21*a* that can freely vibrate. In other words, the vibration body 21*a* has a rectangular film-like (membrane-like) shape and has two surfaces (a surface on the +z direction side and a surface on the −z direction side) which are positioned with a gap therebetween in the +z direction.

The shapes of the frame 25*a* and the frame 25*b* are not limited to the rectangular shape. The shape thereof may be a circular shape or a rhombus shape. In addition, in a case where no frame 25*b* is provided, for example, the film 21 may be adhered onto the surface in the +z direction of the frame 25*a*. In addition, in a case where no frame 25*a* is provided, for example, the film 21 may be adhered onto the surface in the −z direction of the frame 25*b*. In addition, it is sufficient that the vibration body 21*a* has a film-like (membrane-like) shape or a thin sheet-like shape. Therefore, in place of the film 21, the vibration body 21*a* can be formed of thin sheet-like metal, paper, or the like.

The exciter 11 and the exciter 12 are attached to the surface on the −z direction side of the vibration body 21*a*. The exciter 11 and the exciter 12 are piezoelectric elements each of which has a plate-like shape and has rectangular upper and lower main surfaces (a surface in the +z direction and a surface in the −z direction). Each of the exciter 11 and the exciter 12 includes (not illustrated in detail) a stacked body in which piezoelectric layers formed of piezoelectric ceramics, and internal electrode layers are alternately laminated; surface electrode layers which are respectively formed on the upper and lower surfaces (the surface in the +z direction and the surface in the −z direction) of the stacked body; and a pair of terminal electrodes which are respectively provided on both end surfaces (the surface in the +x direction and the surface in the −x direction) of the stacked body in the longitudinal direction. The surface electrodes and the internal electrode layers are alternately drawn out to both the end surfaces of the stacked body in the longitudinal direction and are respectively connected to the terminal electrodes. Then, an electrical signal is applied to the pair of terminal electrodes via wiring (not illustrated).

The exciter 11 and the exciter 12 are bimorph-type piezoelectric elements, in which expansion and contraction become reversed between one side and the other side (the +z direction side and the −z direction side) in the thickness direction at an arbitrary moment when an electrical signal is inputted. Accordingly, when an electrical signal is inputted, the exciter 11 and the exciter 12 generate bending vibrations in the +z direction. The exciter 11 and the exciter 12 themselves vibrate, thereby causing the vibration body 21*a* to vibrate. Then, when the vibration body 21*a* vibrates, a sound is generated.

As the exciter 11 and the exciter 12, for example, monomorph-type vibration elements may be used. Each of the monomorph-type vibration elements is configured to have the piezoelectric element expanding, contracting, and vibrating upon the input of an electrical signal, and a metal plate which are pasted together. In addition, for example, the main surfaces of the exciter 11 and the exciter 12 on the film 21 side and the film 21 are adhered to each other by using a known adhesive such as an epoxy-based resin, a silicone-based resin, and a polyester-based resin; double sided tape; or the like.

As the piezoelectric layers of the exciter 11 and the exciter 12, piezoelectric ceramics which have been used in the related art, such as lead zirconate (PZ), lead zirconate titanate (PZT), and non-lead-based piezoelectric materials such as Bi-layered compounds and tungsten bronze structure compounds can be used. It is desirable that the thickness of one layer in the piezoelectric layers ranges from approximately 10 to 100 μm, for example.

As the internal electrode layers of the exciter 11 and the exciter 12, various types of known metal materials can be used. For example, the internal electrode layers may contain a metal composition consisting of silver and palladium, and a material composition constituting the piezoelectric layer. However, the internal electrode layers may be formed by using a different material. The surface electrode layers and the terminal electrodes of the exciter 11 and the exciter 12 can be formed by using various types of known metal materials. For example, the surface electrode layers and the terminal electrodes of the exciters can be formed by using a metal composition consisting of silver, and a material containing a glass composition. However, the surface electrode layers and the terminal electrodes of the exciters may be formed by using a different material.

The resin layer 23 is provided throughout the inside of the frame 25*a* so that the exciter 11 and the exciter 12 are embedded. The resin layer 23 can be formed by using various types of known materials. For example, a resin such as an acrylic resin and a silicone resin, or rubber can be used. In addition, it is desirable that the thickness of the resin layer is a thickness to the extent that the resin layer 23 completely covers the exciter 11 and the exciter 12. However, it is sufficient that the resin layer 23 is formed so as to cover at least a portion of the film 21. The resin layer 23 brings an effect of enhancing the quality of a sound generated from the acoustic generator. However, the resin layer 23 is not essential, and the resin layer 23 may be excluded in some cases.

The damping material 31 and the damping material 32 are attached to the surface on the +z direction side of the vibration body 21*a*. In addition, each of the damping material 31 and the damping material 32 is formed so as to overlap a portion of the vibration body 21*a* when viewed in the +z direction. In addition, the damping material 31 has a portion 31*a* which overlaps the exciter 11 when viewed in the +z direction, and the damping material 32 has a portion 32*a* which overlaps the exciter 12 when viewed in the +z direction. The area of the portion 31*a* and the area of the portion 32*a* are different from each other.

In addition, a midpoint 15 of a segment connecting a center of gravity 13 of the exciter 11 and a center of gravity 14 of the exciter 12 is positioned closer to the +x direction side than to a center of gravity 16 of the vibration body 21*a* when viewed in the +z direction. Then, the portion 31*a* overlaps the end in the −x direction of the exciter 11 when viewed in the +z direction, and the portion 32*a* overlaps the end in the −x direction of the exciter 12 when viewed in the +z direction.

It is sufficient that the damping material 31 and the damping material 32 have mechanical losses. It is desirable that each of the members thereof has a high mechanical loss factor, that is, a low mechanical quality factor (so-called mechanical Q). Although such a damping material 31 and a damping material 32 can be formed by using various types of elastic bodies, for example, it is desirable that the damping material 31 and the damping material 32 are soft and are likely to be deformed. Therefore, the damping material 31 and the damping material 32 can be favorably formed by using a rubber material such as urethane rubber, or a soft resin material such as a silicone resin. Particularly, a porous rubber material such as urethane foam can be favorably used. The portion to which the damping material 31 and the damping material 32 are attached is subjected to vibration loss due to the damping material 31 and the damping material 32. Accordingly, it is possible to reduce the vibration amplitude of the portion to which the damping material 31 and the damping material 32 are attached.

In this manner, the acoustic generator of the present embodiment has the vibration body 21*a*, the exciter 11, the exciter 12, the damping material 31, and the damping material 32. The vibration body 21*a* has the two surfaces which are positioned with a gap therebetween in the +z direction. The exciter 11 and the exciter 12 are disposed on the vibration body 21*a*. The damping material 31 has the portion 31*a* which overlaps the exciter 11 when viewed in the +z direction and is disposed on the vibration body 21*a*. The damping material 32 has the portion 32*a* which overlaps the exciter 12 when viewed in the +z direction and is disposed on the vibration body 21*a*. According to such a configuration, a high-quality sound having little distortion can be generated.

The reason for being able to obtain the effect can be assumed as follows. In the acoustic generator of the present embodiment, the exciter 11 and the exciter 12 are attached to the vibration body 21*a*, and each of the exciter 11 and the exciter 12 vibrates in response to an electrical signal. Accordingly, the symmetric properties in the vibration of the vibration body 21*a* can be lowered, and a rapid change of the sound pressure in a particular frequency caused by resonance can be reduced. In addition, in the acoustic generator of the present embodiment, the damping material 31 and the damping material 32 are attached to the vibration body 21*a*. Then, the damping material 31 has the portion 31*a* which overlaps the exciter 11 when viewed in the +z direction, and the damping material 32 has the portion 32*a* which overlaps the exciter 12 when viewed in the +z direction. Accordingly, harmonic distortion can be reduced by reducing vibrations in the vicinities of the exciter 11 and the exciter 12 in which the vibration amplitude of the harmonic is significant.

In addition, in the acoustic generator of the present embodiment, the area of the portion 31*a* and the area of the portion 32*a* are different from each other. Accordingly, the symmetric properties in the vibration of the vibration body 21*a* can be further lowered. Therefore, a rapid change of the sound pressure in a particular frequency can be reduced. Thus, distortion can be further reduced. However, the configuration is not essential and the embodiment does not have to be configured as described above in some cases.

In addition, in the acoustic generator of the present embodiment, the shape of the portion 31*a* and the shape of the portion 32*a* are different from each other. Accordingly, the symmetric properties in the vibration of the vibration body 21*a* can be further lowered. Therefore, a rapid change of the sound pressure in a particular frequency can be reduced. Thus, distortion can be reduced. However, the configuration is not essential and the embodiment does not have to be configured as described above in some cases.

In addition, in the acoustic generator of the present embodiment, the exciter 11 has a portion 11*a* which does not overlap the damping material 31 when viewed in the +z direction, and the exciter 12 has a portion 12*a* which does not overlap the damping material 32 when viewed in the +z direction, and the area of the portion 11*a* and the area of the portion 12*a* are different from each other. Accordingly, the symmetric properties in the vibration of the vibration body 21*a* can be further lowered. Therefore, a rapid change of the sound pressure in a particular frequency can be reduced. Thus, distortion can be reduced. However, the configuration is not essential and the embodiment does not have to be configured as described above in some cases.

In addition, in the acoustic generator of the present embodiment, the shape of the portion 11*a* and the shape of the portion 12*a* are different from each other. Accordingly, the symmetric properties in the vibration of the vibration body 21*a* can be further lowered. Therefore, a rapid change of the sound pressure in a particular frequency can be reduced. Thus, distortion can be reduced. However, the configuration is not essential and the embodiment does not have to be configured as described above in some cases.

In addition, in the acoustic generator of the present embodiment, the midpoint 15 of the segment connecting the center of gravity 13 of the exciter 11 and the center of gravity 14 of the exciter 12 is positioned closer to the +x direction side than to the center of gravity 16 of the vibration body 21*a* when viewed in the +z direction. The portion 31*a* overlaps the end in the −x direction of the exciter 11 when viewed in the +z direction, and the portion 32*a* overlaps the end in the −x direction of the exciter 12 when viewed in the +z direction. Accordingly, a high-quality sound having little distortion can be generated. When the exciter 11 and the exciter 12 are disposed so as to be biased to the +x direction side on the vibration body 21*a*, the ends in the −x direction of the exciter and the exciter 12 become portions in which the vibration amplitude in the high-order resonance mode is relatively significant. Therefore, it is assumed that harmonic distortion of a sound generated from the acoustic generator may be able to be reduced by providing the damping material 31 and the damping material 32 so as to be in contact with the portions.

The expression "the +x direction side than to the center of gravity 16 of the vibration body 21*a*" denotes the +x direction side than to a plane perpendicular to the x-axis including the center of gravity 16 of the vibration body 21*a*, and the expression "the −x direction side than to the center of gravity 16 of the vibration body 21*a*" denotes the −x direction side than to a plane perpendicular to the x-axis including the center of gravity 16 of the vibration body 21*a*.

In addition, in most cases, the center of gravity of a figure depicted with the contour of the exciter 11 when viewed in the +z direction may be considered as the center of gravity 13 of the exciter 11 when viewed in the +z direction, and the center of gravity of a figure depicted with the contour of the exciter 12 when viewed in the +z direction may be considered as the center of gravity 14 of the exciter 12 when viewed in the +z direction. Similarly, the center of gravity of a figure depicted with the contour of the vibration body 21*a* when viewed in the +z direction may be considered as the center of gravity 16 of the vibration body 21*a* when viewed in the +z direction. For example, in a case where the exciter 11, the exciter 12, and the vibration body 21*a* have rectangular shapes when viewed in the +z direction, an intersection point of two diagonal lines in each of the shapes may be considered as the center of gravity of each shape.

In addition, in the acoustic generator of the present embodiment, the center of gravity 13 of the exciter 11 is positioned closer to the −x direction side than to the center of gravity 16 of the vibration body 21*a* when viewed in the +z direction, and the end in the +x direction of the damping material 31 is positioned closer to the +x direction side than to the end in the +x direction of the exciter 11. Then, the center of gravity 14 of the exciter 12 is positioned closer to the +x direction side than to the center of gravity 16 of the vibration body 21*a* when viewed in the +z direction, and the end in the −x direction of the damping material 32 is positioned closer to the −x direction side than to the end in the −x direction of the exciter 12. Accordingly, harmonic distortion can be reduced. As a reason for being able to obtain the effect, it is assumed that when the center of gravity 13 of the exciter is positioned closer to the −x direction side than to the center of gravity 16 of the vibration body 21*a* and the center of gravity 14 of the exciter 12 is positioned closer to the +x direction side than to the center of gravity 16 of the vibration body 21*a*, the vibration amplitude in the high-order mode is more significant in the vicinity of the end in the +x direction of the exciter 11 than in the vicinity of the end in the −x direction of the exciter 11, and the vibration amplitude in the high-order mode is more significant in the vicinity of the end in the −x direction of the exciter 12 than in the vicinity of the end in the +x direction of the exciter 12.

In addition, in the acoustic generator of the present embodiment, the midpoint 15 of the segment connecting the center of gravity 13 of the exciter 11 and the center of gravity 14 of the exciter 12 is positioned closer to the +x direction side than to the center of gravity 16 of the vibration body 21*a* when viewed in the +z direction. In addition, the portion 11*a* overlaps the end in the +x direction of the exciter 11 when viewed in the z-axis direction, and the portion 12*a* overlaps the end in the +x direction of the exciter 12 when viewed in the z-axis direction. Accordingly, the sound pressure of a sound generated from the acoustic generator particularly on a low frequency side can be reduced from being lowered. As a reason for being able to obtain the effect, it is assumed that when the exciter 11 and the exciter 12 are disposed so as to be biased to the +x direction side on the vibration body 21*a*, the ends in the +x direction of the exciter 11 and the exciter 12 become the portions in which the vibration amplitude in the basic resonance mode is relatively significant. However, the configuration is not essential and the embodiment does not have to be configured as described above in some cases.

In addition, in the acoustic generator of the present embodiment, it is desirable that the exciter 11 and the exciter are asymmetrically disposed with respect to all symmetric axes (symmetric axes of the line symmetry and the center of the rotational symmetry) in a figure depicted with the contour of the vibration body 21*a*, when viewed in the +z direction. Accordingly, the symmetric properties in the vibration of the vibration body 21*a* can be further lowered. However, the configuration is not essential and the embodiment does not have to be configured as described above.

The acoustic generator of the present embodiment can be manufactured as follows, for example. First, a binder, a dispersant, a plasticizer, and a solvent are added to powder of a piezoelectric material and are agitated, thereby producing slurry. As a piezoelectric material, any one of a lead-based material and a non-lead-based material can be used. Subsequently, the obtained slurry is molded so as to have a sheet-like shape, thereby producing a green sheet. A conductive paste is printed on the green sheet, thereby forming a conductive pattern which serves as an internal electrode. The green sheets having the conductive pattern formed thereon are laminated, thereby producing a laminate molded body.

Subsequently, the laminate molded body is degreased, is fired, and is cut so as to have predetermined dimensions, and a stacked body can be obtained. As necessary, processing the outer circumferential portion of the stacked body is performed. Subsequently, a conductive pattern which serves as the surface electrode layer is formed by printing the conductive paste on a main surface in a stacking direction of the stacked body, and conductive patterns which serve as the pair of terminal electrodes are formed by printing the conductive paste on both end surfaces in a longitudinal direction of the stacked body. Then, the electrodes are baked at a predetermined temperature, and structure bodies which serve as the exciter 11 and the exciter 12 can be obtained. Thereafter, in order to apply piezoelectricity to the exciter 11 and the exciter 12, a DC voltage is applied through the surface electrode layers or the pair of terminal electrodes, thereby performing polarization of the piezoelectric layers of the exciter 11 and the exciter 12. In this manner, the exciter 11 and the exciter 12 can be obtained.

Subsequently, the circumferential edge of the film 21 is interposed between the frame 25*a* and the frame 25*b* to which adhesives are applied and fixed thereto in a state where tensile force is applied, and the adhesives are cured for bonding. Then, the exciter 11 and the exciter 12 are bonded to the film 21 on the surface on the −z direction side of the vibration body 21*a* by using an adhesive, and wiring is connected to the exciter 11 and the exciter 12. Then, a resin is poured into the frame 25*a* and is cured, thereby forming the resin layer 23. Then, the damping material 31 and the damping material 32 prepared in advance are bonded to the surface on the +z direction side of the vibration body 21*a* by using a gluing agent or an adhesive. In this manner, the acoustic generator of the present embodiment can be obtained.

Second Embodiment

Figure 4:
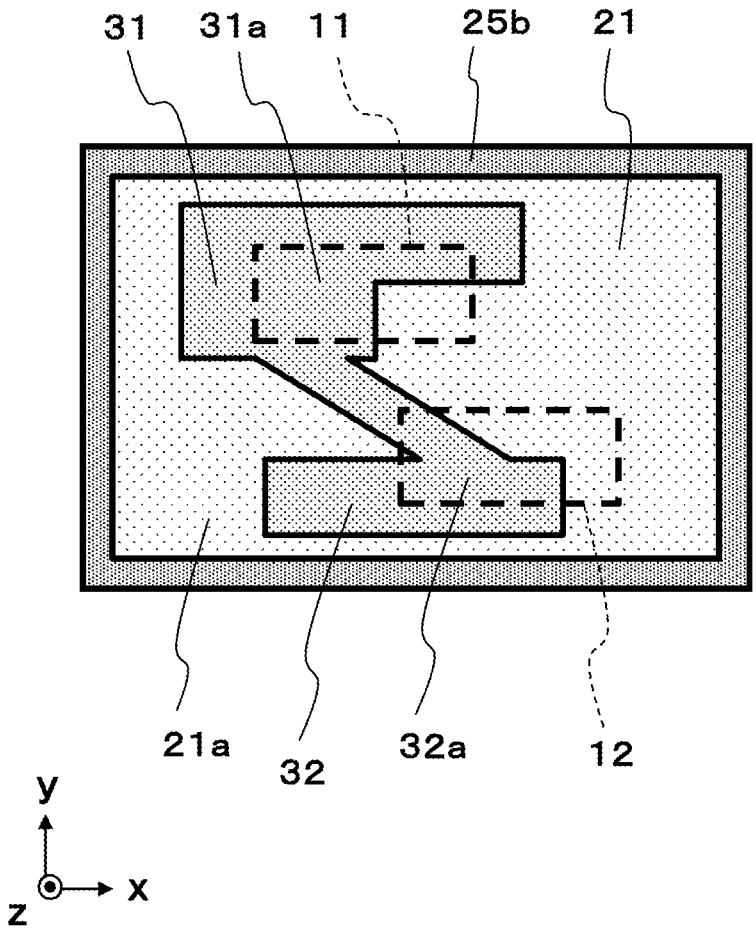
FIG. 4 is a plan view schematically illustrating an acoustic generator according to a second embodiment of the invention when viewed in the +z-direction.

FIG. 4 is a plan view schematically illustrating an acoustic generator according to a second embodiment of the invention viewed from the +z direction side. In the present embodiment, description will be given regarding points different from those of the acoustic generator of the above-described first embodiment. The same reference numerals and signs will be applied to the similar configuration elements, and description thereof will not be repeated.

In the acoustic generation device of the present embodiment, as illustrated in FIG. 4, the damping material 31 and the damping material 32 are integrated (the damping material and the damping material 32 are integrally formed, and the damping material 31 and the damping material 32 are united with each other). Configurations except that described above are the same as those of the acoustic generator of the above-described first embodiment. According to such a configuration, distortion of a sound generated from the acoustic generator can be further reduced. It is assumed that transmission of vibrations occurring via the damping material 31 between a place in the vicinity of the exciter 11 in the vibration body 21*a* and a place in the vicinity of the exciter 12 in the vibration body 21*a* is one of the reasons for being able to obtain the effect.

Third Embodiment

Figure 5:
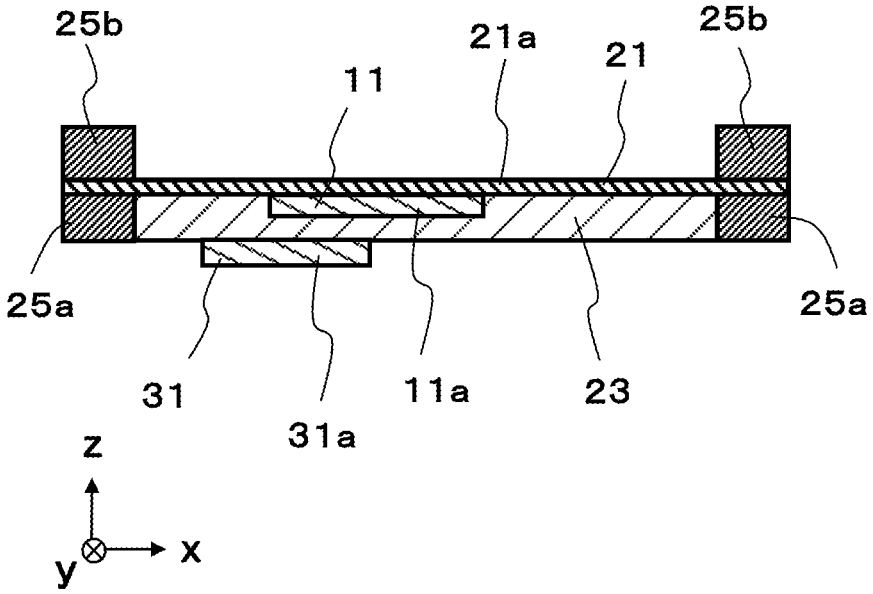
FIG. 5 is a sectional view schematically illustrating an acoustic generator according to a third embodiment of the invention.

FIG. 5 is a sectional view schematically illustrating an acoustic generator according to a third embodiment of the invention. In the present embodiment, description will be given regarding points different from those of the acoustic generator of the above-described second embodiment. The same reference numerals and signs will be applied to the similar configuration elements, and description thereof will not be repeated.

In the acoustic generation device of the present embodiment, as illustrated in FIG. 5, the damping material 31 and the damping material 32 are attached to the surface on the −z direction side of the resin layer 23. In other words, the damping material 31 and the damping material 32 are attached to the vibration body 21*a* via the resin layer 23. Configurations except that described above are the same as the acoustic generator of the above-described second embodiment. The acoustic generator of the present embodiment having such a configuration can also obtain an effect substantially equal to that of the acoustic generator of the above-described second embodiment. In addition, in some cases, the damping material 31 and the damping material 32 may be attached to the vibration body 21*a* via the exciter 11 and the exciter 12. In this manner, it is desirable that the damping material 31 and the damping material 32 are directly attached to the vibration body 21*a*. However, the damping material 31 and the damping material 32 may be attached to the vibration body 21*a* via something else.

Fourth Embodiment

Figure 6:
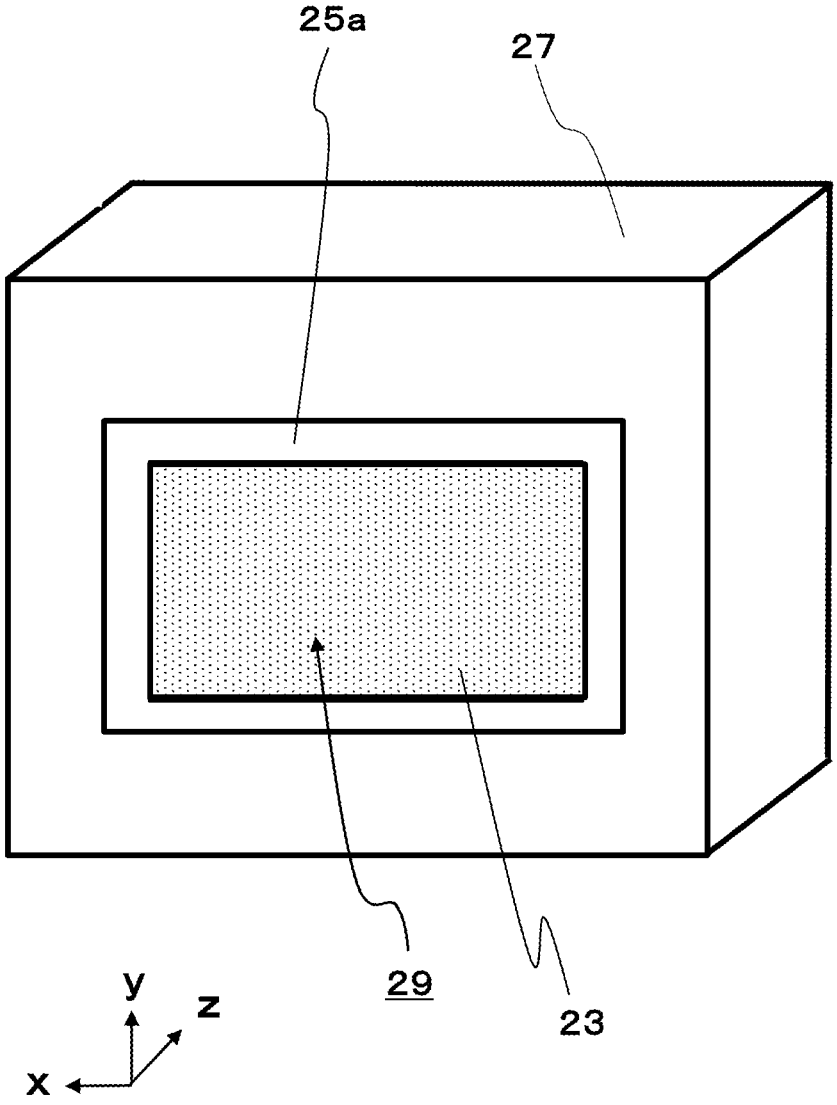
FIG. 6 is a perspective view schematically illustrating an acoustic generation device according to a fourth embodiment of the invention.

FIG. 6 is a perspective view illustrating an acoustic generation device according to a fourth embodiment of the invention. In the present embodiment, description will be given regarding points different from those of the acoustic generator of the above-described first embodiment. The same reference numerals and signs will be applied to the similar configuration elements, and description thereof will not be repeated. As illustrated in FIG. 6, the acoustic generation device of the present embodiment has an acoustic generator 29 and an enclosure 27.

The acoustic generator 29 generates a sound (including a sound out of the audible frequency range) when an electrical signal is inputted. The acoustic generator 29 (not illustrated in detail) is an acoustic generator of the above-described first embodiment.

The enclosure 27 has a rectangular parallelepiped box shape. In addition, the enclosure 27 has at least one opening, and the acoustic generator 29 is attached to the opening so as to block the opening. In addition, the enclosure 27 is configured to surround the main surface of the film 21 on a side where the exciter 11 and the exciter 12 are disposed. It is sufficient that the enclosure 27 has a function of suppressing a sound generated on the rear surface side of the acoustic generator 29 from sneaking to the surface side. Therefore, the shape of the enclosure 27 is not limited to be the rectangular parallelepiped shape. For example, various types of shapes such as a conical shape and a spherical shape may be adopted. In addition, the enclosure 27 is not necessarily box-shaped. For example, the enclosure 27 may be a flat baffle. Such an enclosure 27 can be formed by using various types of known materials. For example, the enclosure 27 can be formed by using materials such as wood, a synthetic resin, and metal.

Since the acoustic generation device of the present embodiment generates a sound by using the acoustic generator 29 which is the acoustic generator of the above-described first embodiment, it is possible to generate a sound of favorable quality. In addition, since the acoustic generation device of the present embodiment has the enclosure 27, it is also possible to generate a sound of more favorable quality than a case of being provided with only the acoustic generator 29. In place of the acoustic generator of the first embodiment, a differently formed acoustic generator having a similar performance may be adopted.

Fifth Embodiment

Figure 7:
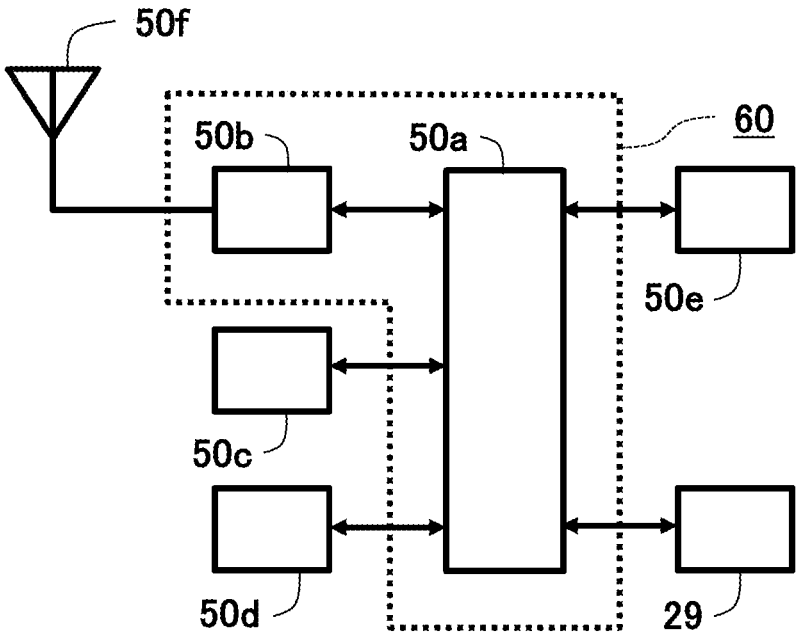
FIG. 7 is a block diagram illustrating a configuration of an electronic apparatus according to a fifth embodiment of the invention.

FIG. 7 is a block diagram illustrating a configuration of an electronic apparatus according to a fifth embodiment of the invention. As illustrated in FIG. 7, the electronic apparatus of the present embodiment has the acoustic generator 29, an electronic circuit 60, a key input section 50*c*, a microphone input section 50*d*, a display section 50*e*, and an antenna 50*f*. For example, FIG. 7 is a block diagram directed to an electronic apparatus such as a portable telephone, a tablet terminal, and a personal computer.

The electronic circuit 60 has a control circuit 50*a* and a communication circuit 50*b*. In addition, the electronic circuit 60 is connected to the acoustic generator 29 and has a function of outputting a voice signal to the acoustic generator 29. The control circuit 50*a* is a control section of the electronic apparatus. The communication circuit 50*b* transmits and receives data via the antenna 50*f* based on the control of the control circuit 50*a*.

The key input section 50*c* is an input device of the electronic apparatus and receives a key input operation performed by an operator. Similarly, the microphone input section 50*d* is an input device of the electronic apparatus and receives a voice input operation and the like performed by an operator. The display section 50*e* is a display output device of the electronic apparatus and outputs display information based on the control of the control circuit 50*a*.

The acoustic generator 29 is the acoustic generator of the above-described first embodiment. The acoustic generator 29 functions as a sound output device in the electronic apparatus and generates a sound (including a sound out of the audible frequency range) based on a voice signal inputted from the electronic circuit 60. The acoustic generator 29 is connected to the control circuit 50*a* of the electronic circuit 60 and generates a sound when a voltage controlled by the control circuit 50*a* is received.

In this manner, the electronic apparatus of the present embodiment has at least the acoustic generator 29 and the electronic circuit 60 which is connected to the acoustic generator 29. The electronic apparatus of the present embodiment has a function of causing the acoustic generator 29 to generate a sound. Since the electronic apparatus of the present embodiment generates a sound by adopting the acoustic generator 29 of the above-described first embodiment, it is possible to generate a sound of favorable quality.

As an example of a structure of the electronic apparatus, for example, as illustrated in FIG. 7, the electronic circuit 60, the key input section 50*c*, the microphone input section 50*d*, the display section 50*e*, the antenna 50*f*, and the acoustic generator 29 can be provided inside a housing of the electronic apparatus. In addition, as another example of the structure of the electronic apparatus, as illustrated in FIG. 7, an apparatus main body including the electronic circuit 60, the key input section 50*c*, the microphone input section 50*d*, the display section 50*e*, and the antenna 50*f* in the housing can be connected to the acoustic generator 29 via a lead wire or the like so that an electrical signal can be transmitted.

In addition, there is no need for the electronic apparatus of the present embodiment to have all of the key input section 50*c*, the microphone input section 50*d*, the display section 50*e*, and the antenna 50*f* illustrated in FIG. 7. It is sufficient that the electronic apparatus includes at least the acoustic generator 29 and the electronic circuit 60. In addition, the electronic apparatus may have other configuration elements. Moreover, the electronic circuit 60 is not also limited to the electronic circuit 60 having the above-described configuration. The electronic apparatus may be an electronic circuit having a different configuration.

In addition, the electronic apparatus of the present embodiment is not limited to the electronic apparatus such as a portable telephone, a tablet terminal, a personal computer, and the like described above. In various types of electronic apparatus such as a television set, an audio apparatus, a radio, a vacuum cleaner, a washing machine, a refrigerator, and a microwave oven having a function of generating a sound or voice, the acoustic generator 29 of the above-described first embodiment can be adopted as the acoustic generation device. In place of the acoustic generator of the first embodiment, a differently formed acoustic generator having a similar performance may be adopted.

Modified Example

The invention is not limited to the above-described embodiments, and various changes and modifications can be made without departing from the scope of the invention.

For example, in the above-described embodiments, an example in which the piezoelectric elements are adopted as the exciter and the exciter 12 has been described. However, the embodiment is not limited thereto. It is sufficient that the exciter 11 and the exciter 12 have functions of converting an electrical signal into a mechanical vibration, and different members having functions of converting an electrical signal into a mechanical vibration may also be adopted as the exciter 11 and the exciter 12. For example, an electrodynamic exciter, an electrostatic exciter, or an electromagnetic exciter widely known as an exciter which causes a speaker to vibrate may be adopted as the exciter 11 and the exciter 12. The electrodynamic exciter is configured to cause a coil disposed between the magnetic poles of a permanent magnet to vibrate by applying a current to the coil. The electrostatic exciter is configured to cause two metal plates which face each other to vibrate by applying a bias and an electrical signal thereto. The electromagnetic exciter is configured to cause a thin iron plate to vibrate by applying an electrical signal to a coil.

In addition, in the above-described embodiments, an example in which two exciters (the exciter 11 and the exciter 12) are attached to the surface of the film 21 has been described. However, the embodiment is not limited thereto. For example, three or more exciters may be attached to the surface of the film 21. In this case, it is desirable that the damping material and the damping material 32 respectively have portions overlapping all the exciters attached to the vibration body 21*a* when viewed in the thickness direction of the vibration body 21*a*. Accordingly, the effect of reducing distortion can be enhanced. In this case as well, it is desirable that the damping material 31 and the damping material 32 do not cover the vibration body 21*a* in its entirety and are formed so as to overlap the portion of the vibration body 21*a* when viewed in the +z direction. In some cases, there may be an exciter which does not overlap the damping material 31 and the damping material 32 when viewed in the thickness direction of the vibration body 21*a*. In addition to the damping material 31 and the damping material 32, another damping material may be attached to the vibration body 21*a*. In this case, it is desirable that all the exciters overlap any one of the damping materials when viewed in the thickness direction of the vibration body 21*a*. However, the embodiment does not have to be configured as described above in some cases.

Example

Subsequently, a specified example of the invention will be described. The acoustic generator of the second embodiment illustrated in FIG. 4 was produced, and the characteristics thereof were evaluated.

First, piezoelectric powder containing lead zirconate titanate (PZT) in which a portion of Zr was replaced with Sb, a binder, a dispersant, a plasticizer, and a solvent were kneaded by performing ball mill mixing, and slurry was produced. Then, a green sheet was produced by using the obtained slurry through a doctor blade method. A conductive paste containing Ag and Pd was applied to the green sheet through a screen printing method so as to have a predetermined shape, and a conductive pattern serving as an internal electrode layer was formed. Then, the green sheet having the conductive pattern formed therein and other green sheets were laminated and pressurized, and a laminate molded body was produced. Then, the laminate molded body was degreased at the temperature of 500° C. for an hour in the atmosphere. Thereafter, the degreased laminate molded body was burned at the temperature of 1100° C. for three hours in the atmosphere, and a stacked body was obtained.

Subsequently, both end surface portions of the obtained stacked body in the longitudinal direction were cut by performing dicing processing, and the tips of the internal electrode layers were exposed to the side surfaces of the stacked body. Then, the conductive pastes containing Ag and glass were applied to the main surfaces of the stacked body on both sides through the screen printing method, and the surface electrode layers were formed. Thereafter, the conductive pastes containing Ag and glass were applied to both the side surfaces of the stacked body in the longitudinal direction through a dip method, the stacked body was baked at the temperature of 700° C. for ten minutes in the atmosphere, and terminal electrodes were formed. In this manner, the stacked body was produced. Regarding the shape of the produced stacked body, the width was mm, the length was 36 mm, and the thickness was 0.15 mm. Then, polarization was performed by applying a voltage of 100 V through the terminal electrodes for two minutes, and an exciter and an exciter 12, which were bimorph-type laminated piezoelectric elements, were obtained.

Subsequently, a PET film 21 having the thickness of 25 μm was prepared, and the film 21 was fixed to a frame 25*a* and a frame 25*b* in a state where tensile force was acting. As the frame 25*a* and the frame 25*b*, stainless steel frames having the thickness of 0.5 mm were adopted. Regarding the dimensions of the film 21 within the frame 25*a* and the frame 25*b*, the length was 100 mm and the width was 60 mm. Then, the exciter 11 and the exciter 12 were adhered to the main surface of the fixed film 21 on one side by using an adhesive made of an acrylic resin, and wiring was connected to the exciter 11 and the exciter 12. Then, the inside of the frame 25*a* was filled with an acrylic-based resin so as to have the same height as that of the frame 25*a*. The resin was solidified, and a resin layer 23 was formed.

Subsequently, a damping material 31 and a damping material 32 were stuck on the main surface of the film 21 on the other side by using double sided tape. As the damping material 31 and the damping material 32, urethane foam materials having the thickness of 1 mm were used. The shapes and the attachment positions of the damping material 31 and the damping material 32 were adopted as those illustrated in FIG. 4.

Figure 8:
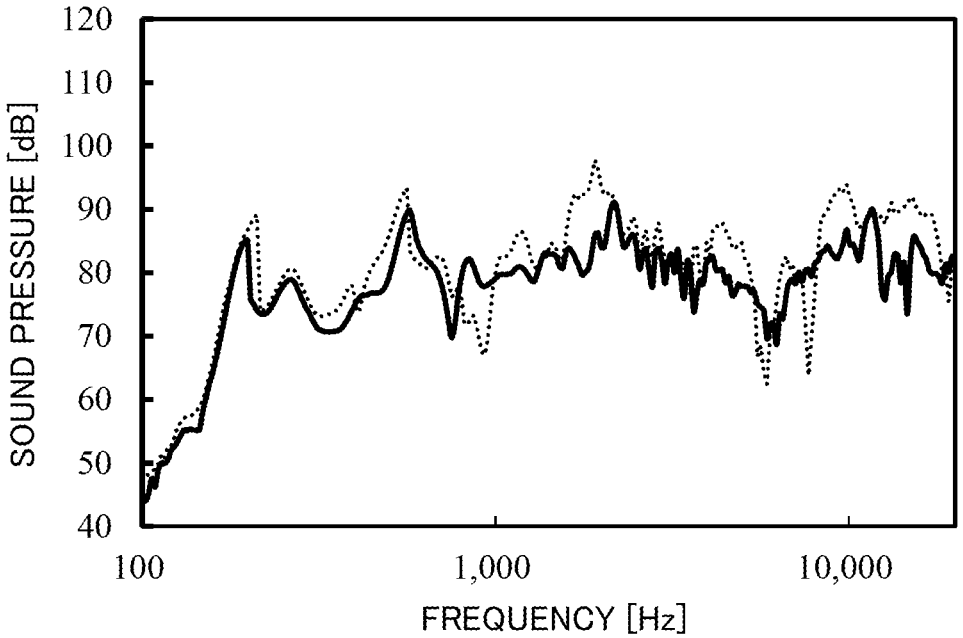
FIG. 8 is a graph illustrating frequency characteristics of sound pressure of the acoustic generator according to the first embodiment of the invention and an acoustic generator of the comparative example.
Figure 9:
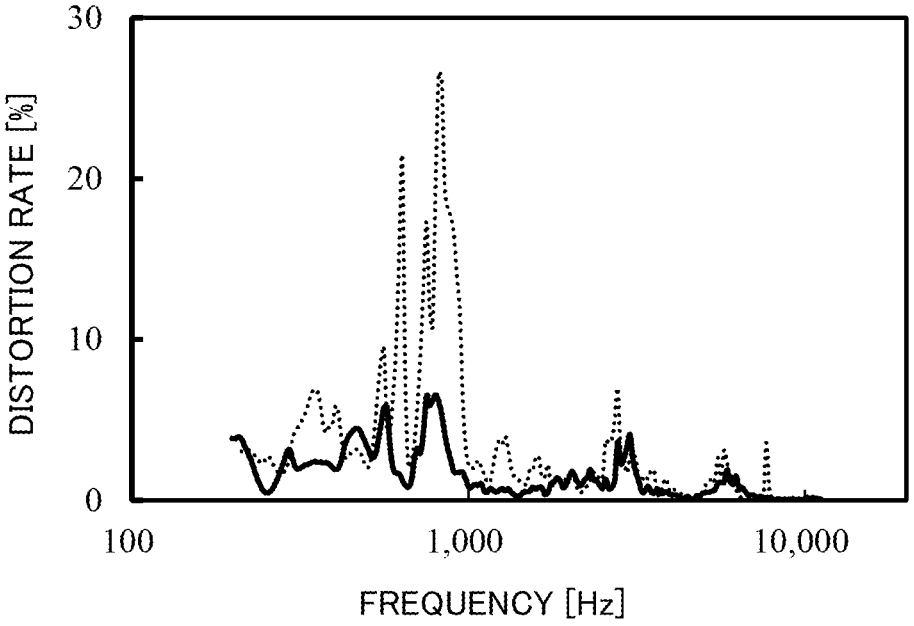
FIG. 9 is a graph illustrating frequency characteristics of distortion rates of the acoustic generator according to the first embodiment of the invention and the acoustic generator of the comparative example.

Then, frequency characteristics of the sound pressure were measured with respect to sounds respectively generated from the produced acoustic generator of the second embodiment and the acoustic generator of a comparative example in which the damping material 31 and the damping material 32 were not attached. FIG. 8 illustrates the results thereof. In addition, regarding the sounds respectively generated from the acoustic generator of the second embodiment and the acoustic generator of the comparative example, frequency characteristics of distortion rates were measured. FIG. 9 illustrates the measurement results thereof. In the graphs illustrated in FIGS. 8 and 9, the characteristics of the acoustic generator of the second embodiment are indicated with the solid line, and the characteristics of the acoustic generator of the comparative example are indicated with the dotted line.

According to the graphs illustrated in FIGS. 8 and 9, in the sound generated from the acoustic generator of the second embodiment, compared to the sound generated from the acoustic generator of the comparative example, it was possible to know that the frequency characteristics of the sound pressure were flat, the distortion rate was small, and sound quality was favorable while having little distortion. In this manner, the effectiveness of the invention could be confirmed.

REFERENCE SIGNS LIST

11, 12: Exciter
13, 14, 16: Center of gravity
15: Midpoint
21*a*: Vibration body
25*a*, 25*b*: Frame
27: Enclosure
29: Acoustic generator
31, 32: Damping material
60: Electronic circuit

The invention claimed is:

1. An acoustic generator, comprising:
a vibration body having two surfaces which are positioned with a gap therebetween in a first direction;
a first exciter and a second exciter which are disposed on the vibration body;
a first damping material disposed on the vibration body, the first damping material having a first portion which overlaps the first exciter when viewed in the first direction; and
a second damping material disposed on the vibration body, the second damping material having a second portion which overlaps the second exciter when viewed in the first direction,
wherein the first exciter has a third portion which does not overlap the first damping material when viewed in the first direction, and
the second exciter has a fourth portion which does not overlap the second damping material when viewed in the first direction.

2. The acoustic generator according to claim 1,
wherein an area of the first portion and an area of the second portion are different from each other.

3. The acoustic generator according to claim 1,
wherein a shape of the first portion and a shape of the second portion are different from each other.

4. The acoustic generator according to claim 1,
wherein an area of the third portion and an area of the fourth portion are different from each other.

5. The acoustic generator according to claim 1,
wherein a shape of the third portion and a shape of the fourth portion are different from each other.

6. An acoustic generator, comprising:
a vibration body having two surfaces which are positioned with a gap therebetween in a first direction;
a first exciter and a second exciter which are disposed on the vibration body;
a first damping material disposed on the vibration body, the first damping material having a first portion which overlaps the first exciter when viewed in the first direction; and
a second damping material disposed on the vibration body, the second damping material having a second portion which overlaps the second exciter when viewed in the first direction,
wherein when one direction perpendicular to the first direction is described as a second direction, a midpoint of a segment connecting a center of gravity of the first exciter and a center of gravity of the second exciter is positioned closer to a second direction side than to a center of gravity of the vibration body when viewed in the first direction, and
when a direction opposite to the second direction is described as a third direction, the first portion is in contact with an end portion in the third direction of the first exciter when viewed in the first direction and the second portion is in contact with an end portion in the third direction of the second exciter when viewed in the first direction.

7. The acoustic generator according to claim 6,
Wherein, when viewed in the first direction, the center of gravity of the first exciter is positioned closer to a third direction side than to the center of gravity of the vibration body, and an end portion in the second direction of the first damping material is positioned closer to the second direction side than to an end portion in the second direction of the first exciter, and
when viewed in the first direction, the center of gravity of the second exciter is positioned closer to the second direction side than to the center of gravity of the vibration body, and an end portion in the third direction of the second damping material is positioned closer to the third direction side than to an end portion in the third direction of the second exciter.

8. The acoustic generator according to claim 1,
wherein the first damping material and the second damping material are integrated.

9. The acoustic generator according to claim 1, further comprising:
a resin layer which covers at least a portion of the vibration body,
wherein the first damping material and the second damping material are attached to the vibration body via the resin layer.

10. An acoustic generation device, comprising:
the acoustic generator according to claim 1; and
an enclosure attached to the acoustic generator.

11. An electronic apparatus, comprising:
the acoustic generator according to claim 1; and
an electronic circuit connected to the acoustic generator.

12. An acoustic generation device, comprising:
the acoustic generator according to claim 6; and
an enclosure attached to the acoustic generator.

13. An electronic apparatus, comprising:
the acoustic generator according to claim 6; and
an electronic circuit connected to the acoustic generator.

* * * * *